US006421945B1

(12) United States Patent
Hengstenberg

(10) Patent No.: US 6,421,945 B1
(45) Date of Patent: Jul. 23, 2002

(54) MUZZLELOADING SHOTGUN WITH CHOKE

(75) Inventor: Eric T. Hengstenberg, Centerville, IA (US)

(73) Assignee: EBSCO Indusries, Inc., Birmingham, AL (US)

( * ) Notice: Subject to any disclaimer, the term of this patent is extended or adjusted under 35 U.S.C. 154(b) by 0 days.

(21) Appl. No.: 09/503,528

(22) Filed: Feb. 14, 2000

(51) Int. Cl.[7] ..... F41A 21/40

(52) U.S. Cl. ..... 42/79; 42/51; 42/76.01; 89/14.05

(58) Field of Search ..... 42/51, 79, 76.01; 89/1.3, 14.05

(56) References Cited

U.S. PATENT DOCUMENTS 4,467,546 A * 8/1984 Beretta ..... 42/79
5,157,211 A * 10/1992 Mossberg ..... 42/79
5,642,583 A * 7/1997 Ball et al. ..... 42/51
6,145,235 A * 11/2000 Emerson et al. ..... 42/90

FOREIGN PATENT DOCUMENTS

SU 164217 * 8/1964 ..... 42/79

* cited by examiner

*Primary Examiner*—Stephen M. Johnson

(57) ABSTRACT

A muzzleloading shotgun has a barrel with a constant inside diameter that flares outwardly a short distance from the muzzle to a constant diameter. The muzzle end of the barrel has exterior threads which receive the interior threads of a choke. The choke has an internal diameter that tapers inwardly as it progresses from the end of the barrel to the end of the choke. The flared portion of the shotgun barrel allows the shot pattern to expand as it approaches the discharge end of the barrel. The shot within the constant diameter portion of the barrel becomes condensed as it moves outwardly through the choke to achieve the desired concentrated shot pattern. Because the choke is tapered from the enlarged diameter created by the flared portion of the barrel, to a narrower portion at the discharge end thereof, the effective internal diameter of the choke at its discharge end is still large enough to permit the shotgun to be reloaded through that end without the removal of the choke from the shotgun barrel.

9 Claims, 3 Drawing Sheets

MUZZLELOADING SHOTGUN WITH CHOKE

FIELD OF THE INVENTION

This invention relates to a muzzleloading shotgun with a choke that will condense the shot pattern, but which will still permit the shotgun to be loaded through the muzzle without removing the choke.

BACKGROUND OF THE INVENTION

There is a need to place chokes on muzzleloading shotguns just as there is with any conventional shotgun. However, by decreasing the effective diameter of the muzzleloading barrel at its discharge end, by placing a choke thereon, it is commonly not possible to reload the shotgun through the muzzle without first removing the choke. This is an inconvenient and time-consuming task, particularly when conducted in the hunting field.

It is therefore a principal object of this invention to provide a muzzleloading shotgun with a choke which will effectively condense the shot pattern, but which has a sufficient diameter that the shotgun can be reloaded without having to remove the choke because of its restricted diameter.

A further object of the invention is to provide a muzzleloading shotgun with a choke which is easily installed and cleaned.

These and other objects will be apparent to those skilled in the art.

SUMMARY OF THE INVENTION

A muzzleloading shotgun has a barrel with a constant inside diameter that flares outwardly a short distance from the muzzle to a constant diameter. The muzzle end of the barrel has exterior threads which receive the interior threads of a choke. The choke has an internal diameter that tapers inwardly as it progresses from the end of the barrel to the end of the choke. The flared portion of the shotgun barrel allows the shot pattern to expand as it approaches the discharge end of the barrel. The shot within the constant diameter portion of the barrel becomes condensed as it moves outwardly through the choke to achieve the desired concentrated shot pattern. Because the choke is tapered from the enlarged diameter created by the flared portion of the barrel, to a narrower portion at the discharge end thereof, the effective internal diameter of the choke at its discharge end is still large enough to permit the shotgun to be reloaded through that end without the removal of the choke from the shotgun barrel.

A BRIEF DESCRIPTION OF THE DRAWINGS

DESCRIPTION OF THE PREFERRED EMBODIMENT

Figure 1:
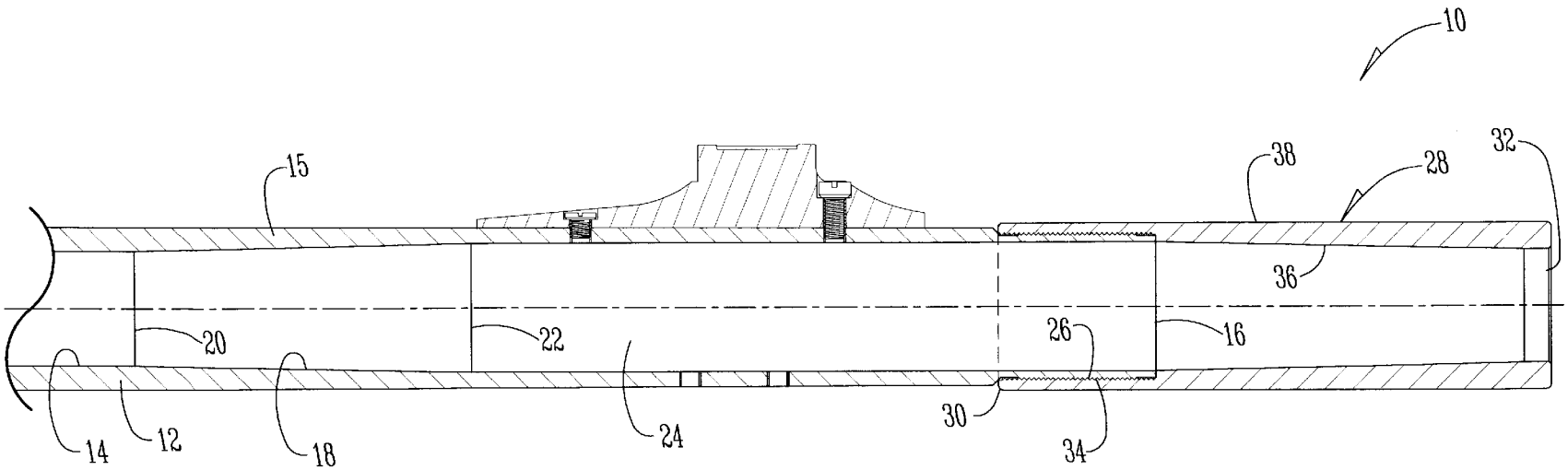
FIG. 1 is a sectional view of a muzzleloading shotgun barrel of this invention with the choke tube attached to the discharge end of the barrel.
Figure 2:
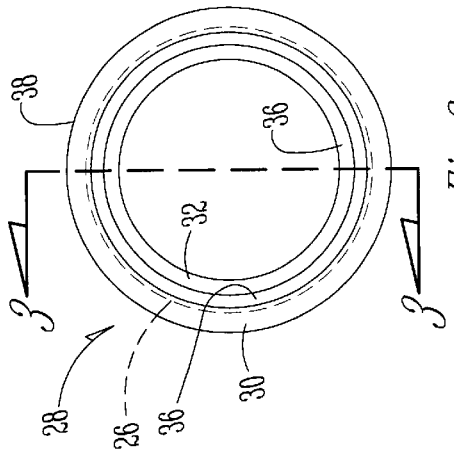
FIG. 2 is an enlarged scale end elevational view of the invention as viewed from the right-hand end of FIG. 1.
Figure 3:
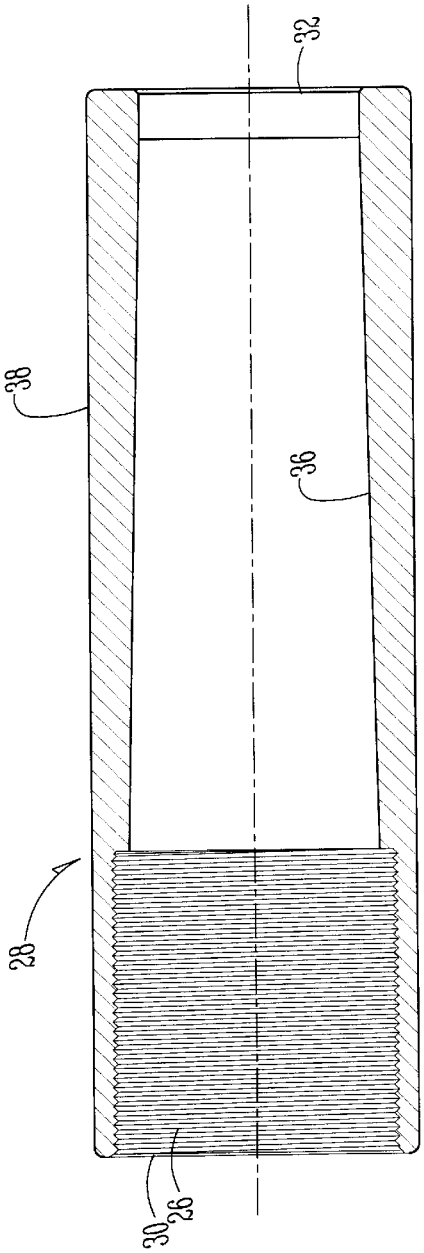
FIG. 3 is a longitudinal sectional view of the choke.
Figure 4:
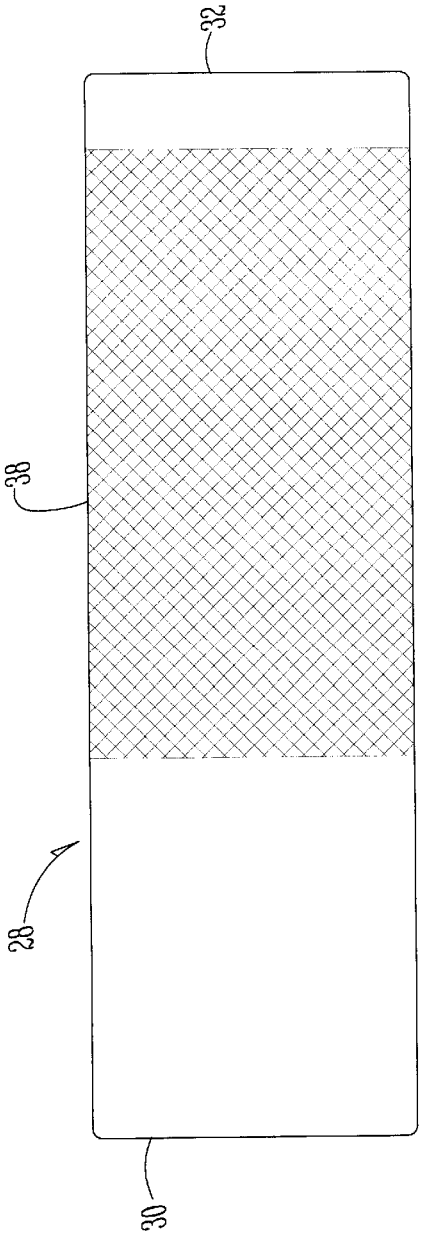
FIG. 4 is a side or top elevational view of the choke at an enlarged scale.
Figure 5:
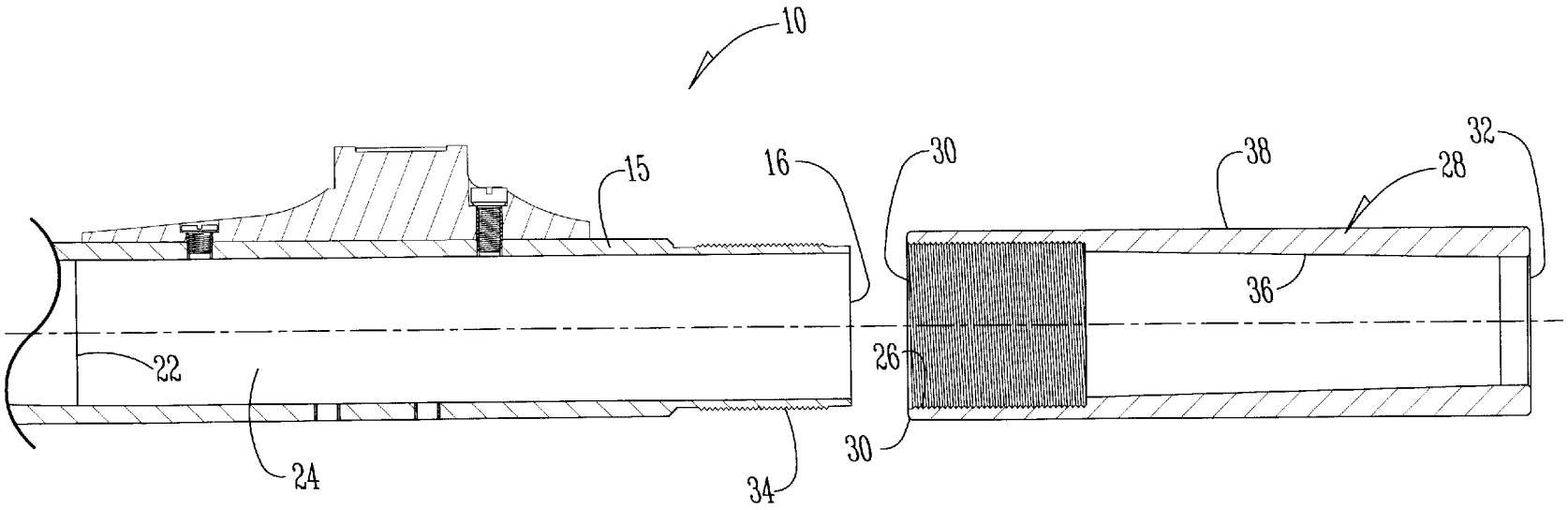
FIG. 5 is an exploded sectional view of the choke about to be placed on the end of the shotgun barrel.

With reference to FIG. 1, the muzzleloading shotgun 10 has a barrel 12 with the substantial rearward portion of the barrel having an internal constant diameter 14. That diameter is typically 0.728 inches. The outer diameter 15 of the barrel is constant through its length. The discharge end of the barrel is represented by the numeral 16. Towards the end of the barrel 16, the constant diameter portion 14 of the barrel is increased through the tapered portion 18 from diameter 20 to diameter 22. The diameter 20 typically would be 0.728 inches and the diameter 22 would be typically 0.820 inches. The diameter 22 then becomes of a constant value in portion 24 until that portion terminates into an externally threaded portion 26.

The choke 28 of this invention has a connection end 30 and a discharge end 32. The internal diameter of choke 28 has internal threads 34 adjacent the connection end 30 which are compatible with the external threads 26 on the end of barrel 12. With reference to FIG. 1, when the choke is installed in threaded condition on the end of barrel 12, a tapered bore 36 extends from the end 16 of barrel 12 to the discharge end 32 of the choke. The outer diameter 38 of the choke is of constant diameter and is essentially the same as the external diameter of the barrel 12.

The tapered bore 36 in choke 28 narrows from a diameter of 0.820 inches adjacent end 16 of the barrel 12 to an internal diameter of 0.722 inches at the discharge end 32. Thus, the diameter of the choke at end 32 is very close to being the same as the internal diameter portion 14 of barrel 12. In operation, when the shotgun is fired, the shot moves down the barrel 12 through the portion 14 and then expands in portion 18 to a greater diameter, namely, approximately 0.820 inches as it enters the constant diameter portion 24. When the shot moves from the end of the barrel 16, the shot pattern begins to decrease as it moves outwardly through the tapered bore 36 of the choke 28. This results in the shot being condensed and achieves the primary purpose of the choke 28.

It is very important to note, however, that the discharge end 32 of the choke is substantially the same as the internal diameter of portion 14 of barrel 12 so that the shotgun can be reloaded through the discharge end 32 without having to remove the choke 28 from the end of barrel 12. The enlarged diameter of the end of the choke 32 is achieved by reason of the flare that occurs in the internal diameter of the shotgun barrel as described above in regard to tapered portion 18 and enlarged internal diameter portion 24.

It should also be noted that since the choke 28 can be threadably mounted on the exterior threaded surface of the barrel 12, (via threads 26) the choke does not in any way decrease the effective diameter of the barrel 12.

Most of the outer diameter surface 38 of the choke is knurled so as to give the operator a comfortable and effective handhold when the choke is installed or removed.

It is therefore seen that this invention will achieve at least all of its stated objectives.

What is claimed:

1. A muzzleloading shotgun having an elongated hollow barrel, comprising, the hollow barrel having a receiver end and a discharge end with internal diameters, the internal diameter of the hollow barrel being longitudinally tapered outwardly adjacent the discharge end and thence terminating in a portion of constant increased diameter, a choke having an inwardly tapered bore extending outwardly and positioned inwardly from the discharge end of the barrel and extending to a discharge end of the choke, an inward end of the choke having a diameter the same as the portion of constant increased diameter with the junction between the inner end of the choke and the portion of constant increased diameter being free from any protruding shoulders to provide a smooth passage from the portion of constant increased diameter into the inner end of the choke, the discharge end of the choke having a diameter substantially the same as the internal diameter of the barrel adjacent its receiver end to permit any shot loads that can be received in the receiver end of the barrel to also be placed within the discharge end of the choke so that the choke will not have to be removed from the barrel to reload the shotgun through the discharge end of the barrel.

2. The device of claim 1 wherein external threads on the end of the barrel receive internal threads on an adjacent end of the choke to hold the choke on the barrel.

3. The device of claim 1 wherein the barrel and the choke have external diameters that are approximately equal.

4. The device of claim 1 wherein the internal diameter of the discharge end of the choke is approximately 0.722 inches and the internal diameter of the receiver end of the barrel is approximately 0.728 inches.

5. The device of claim 4 wherein the portion of constant diameter is approximately 0.820 inches.

6. A muzzleloading shotgun having an elongated hollow barrel, comprising, the hollow barrel having a receiver end and a discharge end with internal diameters, the internal diameter of the hollow barrel being longitudinally tapered outwardly adjacent the discharge end and thence terminating in a portion of constant increased diameter, a choke having an inwardly tapered bore extending outwardly and positioned inwardly from the discharge end of the barrel and extending to a discharge end of the choke, the discharge end of the choke having a diameter substantially the same as the internal diameter of the barrel adjacent its receiver end to permit any shot loads that can be received in the receiver end of the barrel to also be placed within the discharge end of the choke so that the choke will not have to be removed from the barrel to reload the shotgun through the discharge end of the barrel, and external threads on the end of the barrel receive internal threads on an adjacent end of the choke to hold the choke on the barrel.

7. A muzzleloading shotgun having an elongated hollow barrel, comprising, the hollow barrel having a receiver end and a discharge end with internal diameters, the internal diameter of the hollow barrel being longitudinally tapered outwardly adjacent the discharge end and thence terminating in a portion of constant increased diameter, a choke having an inwardly tapered bore extending outwardly and positioned inwardly from the discharge end of the barrel and extending to a discharge end of the choke, the discharge end of the choke having a diameter substantially the same as the internal diameter of the barrel adjacent its receiver end to permit any shot loads that can be received in the receiver end of the barrel to also be placed within the discharge end of the choke so that the choke will not have to be removed from the barrel to reload the shotgun through the discharge end of the barrel, and the barrel and the choke have external diameters that are approximately equal.

8. A muzzleloading shotgun having an elongated hollow barrel, comprising, the hollow barrel having a receiver end and a discharge end with internal diameters, the internal diameter of the hollow barrel being longitudinally tapered outwardly adjacent the discharge end and thence terminating in a portion of constant increased diameter, a choke having an inwardly tapered bore extending outwardly and positioned inwardly from the discharge end of the barrel and extending to a discharge end of the choke, the discharge end of the choke having a diameter substantially the same as the internal diameter of the barrel adjacent its receiver end to permit any shot loads that can be received in the receiver end of the barrel to also be placed within the discharge end of the choke so that the choke will not have to be removed from the barrel to reload the shotgun through the discharge end of the barrel, and the internal diameter of the discharge end of the choke is approximately 0.722 inches and the internal diameter of the receiver end of the barrel is approximately 0.728 inches.

9. The device of claim 8 wherein the portion of constant diameter is approximately 0.820 inches.

* * * * *